US009783268B2

(12) United States Patent
Witteman et al.

(10) Patent No.: US 9,783,268 B2
(45) Date of Patent: Oct. 10, 2017

(54) ASSEMBLY OF CHAIN STOPPER AND CHAIN, AND CHAIN STOPPER FOR USE THEREIN

(71) Applicant: BLUEWATER ENERGY SERVICES B.V., Hoofddorp (NL)

(72) Inventors: Renatus Timotheus Gerardus Witteman, Roelofarendsveen (NL); Jimme Kruijt, Voorschoten (NL)

(73) Assignee: BLUEWATER ENERGY SERVICES B.V., Hoofddorp (NL)

( * ) Notice: Subject to any disclaimer, the term of this patent is extended or adjusted under 35 U.S.C. 154(b) by 0 days.

(21) Appl. No.: 15/311,139

(22) PCT Filed: Jun. 12, 2014

(86) PCT No.: PCT/EP2014/062235
§ 371 (c)(1),
(2) Date: Nov. 14, 2016

(87) PCT Pub. No.: WO2015/188864
PCT Pub. Date: Dec. 17, 2015

(65) Prior Publication Data

US 2017/0088239 A1 Mar. 30, 2017

(51) Int. Cl.
*B63B 21/18* (2006.01)
*B63B 21/50* (2006.01)
*B63B 21/04* (2006.01)

(52) U.S. Cl.
CPC ..... *B63B 21/18* (2013.01); *B63B 21/04* (2013.01); *B63B 21/50* (2013.01)

(58) Field of Classification Search
CPC ..... B63B 21/00; B63B 21/18; B63B 21/24; B63B 21/50

(Continued)

(56) References Cited

U.S. PATENT DOCUMENTS 3,289,626 A * 12/1966 Petrie ..... B63B 21/18 114/200
2013/0312649 A1* 11/2013 Tomas ..... B63B 21/18 114/200

FOREIGN PATENT DOCUMENTS

GB 1254583 A 11/1971
WO 2013124717 A1 8/2013

OTHER PUBLICATIONS

International Search Report and Written Opinion for International patent application No. PCT/EP2014/062235, dated Feb. 10, 2015.

* cited by examiner

*Primary Examiner* — Lars A Olson
(74) *Attorney, Agent, or Firm* — Steven M. Koehler; Westman, Champlin & Koehler, P.A.

(57) ABSTRACT

An assembly of chain stopper and chain includes a housing, a vertically extending chain channel defined in the housing in which a chain is received and guided and two chain lockers positioned at opposite sides of the chain channel. Each chain locker pivots on a chain locker pivot axis between an inwardly rotated position engaging the chain and preventing a downward shift of the chain, and an outwardly rotated position allowing an upward shift of the chain. Each chain locker is biased towards its inwardly rotated position. Each chain locker pivot axis as a result of forces transmitted by the chain on the respective chain locker is displaceable from its original position to a stable second position in which the respective chain locker, in its inwardly rotated position, is not able to engage the chain in a manner for preventing a downward shift of the chain in the chain channel.

20 Claims, 2 Drawing Sheets

(58) Field of Classification Search
USPC ..... 114/200
See application file for complete search history.

ASSEMBLY OF CHAIN STOPPER AND CHAIN, AND CHAIN STOPPER FOR USE THEREIN

CROSS-REFERENCE TO RELATED PATENT APPLICATION

The present application is a national phase of and claims priority of International patent application Serial No. PCT/EP2014/062235, filed Jun. 12, 2014, and published in English the content of which is hereby incorporated by reference in its entirety.

BACKGROUND

The discussion below is merely provided for general background information and is not intended to be used as an aid in determining the scope of the claimed subject matter.

The invention firstly relates to an assembly of chain stopper and chain, comprising a housing, a vertically extending chain channel defined in the housing in which a chain is received and guided and two chain lockers positioned at opposite sides of the chain channel, wherein each chain locker is pivotably mounted on a chain locker pivot axis for a rotation between an inwardly rotated position for engaging the chain and preventing a downward shift of the chain in the chain channel, and an outwardly rotated position allowing an upward shift of the chain in the chain channel and wherein each chain locker is biased towards its inwardly rotated position.

In a known assembly of this type (as used, for example, on off shore installations, such as facilities for the production of gas or oil) the bias of the chain lockers towards the inwardly rotated position generally will be caused by gravity (although the use of auxiliary biasing means is not excluded). When the chain has to be lifted, the chain links will rotate the chain lockers outwardly and the chain is free to move upward in the chain channel. A downward movement of the chain is prevented because the chain lockers under influence of gravitational forces again will assume the inwardly rotated position in which they will support a chain link. When in such a known assembly the chain has to be lowered, the chain lockers will have to be locked in the outwardly rotated position. In practise this has been done by the use of divers that used locking devices to be positioned between the chain lockers, or by using less robust mechanisms, such as cables or wires extending to above water line. However, recent legislation and safety regulations may be in conflict with such use of divers which had to operate under dangerous conditions (especially conditions in which the chain already has been lifted for allowing the chain lockers to rotate to the outwardly rotated position).

SUMMARY

The Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

An aspect of the present invention is characterized in that each chain locker pivot axis as a result of forces transmitted by the chain on the respective chain locker is displaceable from its original position to a stable second position in which the respective chain locker, in its inwardly rotated position, is not able to engage the chain in a manner for preventing a downward shift of the chain in the chain channel and wherein the chain locker pivot axis is restrainable in its original position.

As long as the chain locker pivot axis is restrained, the assembly will function in the classic manner as described above. However, when the chain locker pivot axis is not restrained, an initial upward movement of the chain not only will cause the chain lockers to rotate to the outwardly rotated position, but also will cause the chain locker pivot axis to move into its stable second position. In this position the chain lockers cannot prevent a successive downward movement of the chain, which then may be lowered. Unrestraining the chain locker pivot axis already may be carried out when the chain is still loading the chain lockers and will preferably be accomplished without the use of divers (for example using a remotely operated vehicle—ROV-). The transition of the chain locker pivot axis from its original position to the stable second position does not require additional means or the use of divers, because this happens automatically as result of an initial upward shift of the chain.

In one embodiment of the assembly the displacement of the chain locker pivot axis is a displacement along an arc of a circle. Although also other types of displacements such as, for example a translation) may be applied, such a displacement along an arc of a circle has the advantage that it may be achieved in a constructive simple manner.

For example, in one specific embodiment the chain stopper pivot axis is supported by first ends of link arms of which opposite second ends can rotate around a link arm pivot axis. The position of the link arm pivot axis and the length of the link arms in a rather simple, yet very reliable manner define the trajectory of the chain stopper pivot axis between its original and second positions. Further, these variables (along with other variables such as the shape and weight distribution of the chain lockers) can be chosen such that it can be ensured that the second position of the chain locker pivot axis is a stable position.

The link arm pivot axis may be defined by a lockable rotatable shaft, wherein the link arms are non-rotatably connected to said rotatable shaft. This means that a forced rotation of said shaft may be used to displace the chain locker pivot axis. Such a forced rotation of the shaft may be necessary for again positioning the chain locker pivot axis in its original position in which the assembly acts in a classic manner. Such a forced rotation of the shaft also may be carried out using an ROV (without the use of divers).

Preferably a removable locking member is provided for locking the rotatable shaft with respect to the housing. As long as the locking member locks the rotatable shaft in the rotational position in which the chain locker pivot axis is in its original position, the assembly will function in the classic manner. After removal of the locking member the above described displacement of the chain locker pivot axis may be caused by lifting the chain. Although it is conceivable that the locking member also is used for locking the rotatable shaft in a rotational position in which the chain locker pivot axis assumes the second position, this generally is not necessary because said second position is a stable position.

In one specific embodiment the removable locking member, at one hand, non-rotatably may engage the rotatable shaft and, on the other hand, non-rotatably may engage the housing, thus coupling the rotatable shaft to the housing.

In such an embodiment the housing, for example, may comprise at least one receptacle surrounding an outer end of the rotatable shaft and configured for receiving a locking plug, wherein the locking plug has a central opening for receiving said outer end of the rotatable shaft with an inner profile lockingly mating with a corresponding outer profile of said outer end of the rotatable shaft, whereas the locking plug further has an outer profile lockingly mating with an inner profile of the receptacle. The outer profile of the outer end of the rotatable shaft and inner profile of the receptacle then also may be used for engaging corresponding profiles of a tool used for the above mentioned forced rotation of the rotatable shaft (for example a standardized hydraulic torque tool for subsea applications of which the shape corresponds to the shape of the locking plug)

In another embodiment of the assembly the housing and chain lockers are provided with cooperating restriction members for preventing a displacement of the chain locker pivot axis from its original position towards its second position before, in the original position of the chain locker pivot axis, a rotation of the chain lockers out of the inwardly rotated position has occurred. These restriction members prevent that outwardly directed forces in the chain lockers as caused by the chain in this original position of the chain locker pivot axis will reach the chain locker pivot axis or link arm pivot axis, if present (with the resultant risk of damaging these parts or other parts of the assembly). Basically this assures that mooring forces in the chain are directly transmitted to the housing of the chain stopper.

Preferably, then, said cooperating restriction members also define the inwardly rotated position of the chain lockers in the second position of the chain locker pivot axis. Thus, in such an embodiment these restriction members not only prevent the chain lockers from engaging the chain (which would result in preventing a downward shift thereof), but also may play an important role in assuring that the second position of the chain locker pivot axis is a stable position.

Constructively the cooperating restriction members may comprise cooperating shoulders on the chain lockers and housing. But other cooperating members may be devised too.

It is noted that the dimensions of the chain channel always will exceed the dimensions of the chain (for coping with dimensional variations of the chain, for example as a result of manufacturing tolerances or as a result of welding seams for closing the chain links), as a result of which the chain may assume positions in the chain channel which are slightly offset or asymmetrical. As a result the position of opposite chain lockers also may differ. However, the dimensions, shapes and (relative) positions of the constitutive parts of the assembly will be such that also in such offset or asymmetrical situations it will be assured that both chain locker pivot axes will reach the stable second position under all operative conditions of the assembly (also conditions in which the chain stopper pivot axes of the chain stoppers extends at an angle with the horizontal).

In a second aspect the invention relates to a chain stopper for use in an assembly comprising a housing, a vertically extending chain channel defined in the housing in which a chain may be received and guided and two chain lockers positioned at opposite sides of the chain channel, wherein each chain locker is pivotably mounted on a chain locker pivot axis for a rotation between an inwardly rotated position for engaging a chain and preventing a downward shift of a chain in the chain channel, and an outwardly rotated position allowing an upward shift of a chain in the chain channel and wherein each chain locker is biased towards its inwardly rotated position. The chain locker pivot axis as a result of forces transmitted by a chain on the respective chain locker is displaceable from its original position to a stable second position in which the respective chain locker, in its inwardly rotated position, is not able to engage a chain in a manner for preventing a downward shift of a chain in the chain channel and wherein the chain locker pivot axis is restrainable in its original position.

BRIEF DESCRIPTION OF THE DRAWINGS

Hereinafter the invention will be elucidated while referring to the drawing in which.

DETAILED DESCRIPTION OF ILLUSTRATIVE EMBODIMENTS

Before in detail describing an embodiment of the assembly and chain stopper used therein, it is noted that the figures, although above shortly indicated as "view" or "cross section", may in part be a combination of these ways for depicting parts of the invention.

Figure 1:
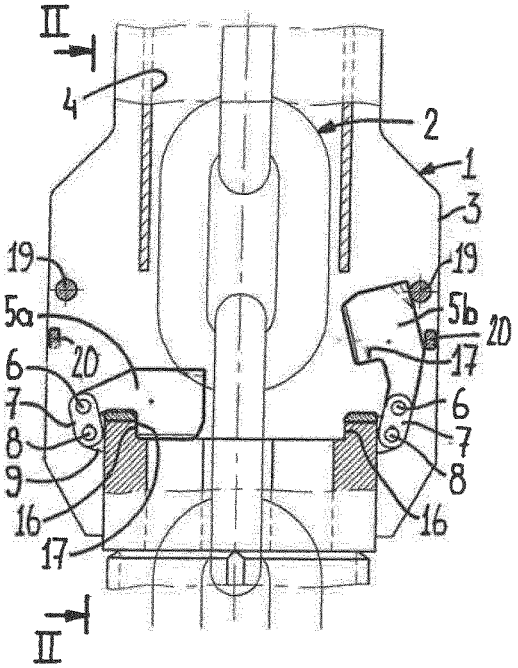
FIG. 1 schematically shows a side elevational view of an embodiment of an assembly.
Figure 2:
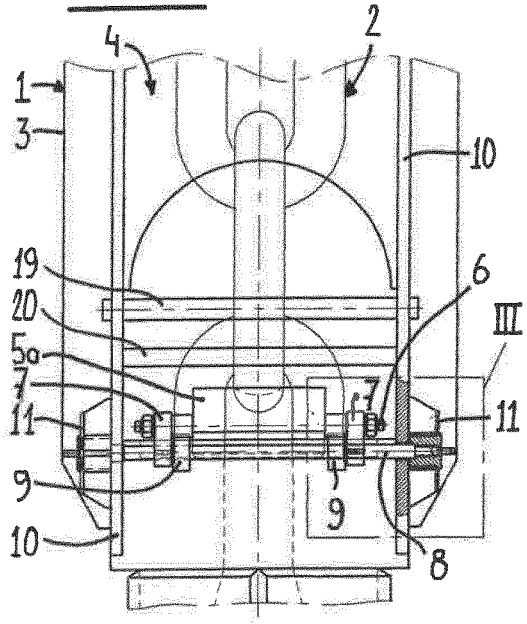
FIG. 2 schematically shows a cross section according to II-II in FIG. 1.

Referring firstly to FIGS. 1 and 2, an assembly of chain stopper 1 and chain 2 is shown. The chain stopper 1 comprises a housing 3 in which a vertically extending chain channel 4 is defined in which the chain 2 is received and guided. In the figures only an upper part of the chain channel 4 has been represented by two walls, but it will be clear that there also may be other parts defining said chain channel.

Two chain lockers 5*a*, 5*b* are positioned at opposite sides of the chain channel 4, wherein each chain locker 5*a*, 5*b* is pivotably mounted on a chain locker pivot axis 6 for a rotation between an inwardly rotated position (as illustrated for chain locker 5*a* for engaging the chain 2 and preventing a downward shift of the chain 2 in the chain channel 4, and an outwardly rotated position (as illustrated for chain locker 5*b*) allowing an upward shift of the chain 2 as defined by the chain channel 4. Under normal operational conditions both chain lockers 5*a*, 5*b* will assume almost identical positions. It is noted however, that the dimensions of the chain channel always will exceed the dimensions of the chain (for coping with dimensional variations of the chain, for example as a result of manufacturing tolerances or as a result of welding seams for closing the chain links), as a result of which the chain may assume positions in the chain channel which are slightly offset or asymmetrical. As a result the position of opposite chain lockers also may differ slightly. Each chain locker is biased towards its inwardly rotated position, generally by gravity. Thus, when the chain 2 is lifted in the chain channel 4 a chain link (such as chain link 2') will push the chain lockers to the position according to chain locker 5*b*. After passage of said chain link 2' both chain lockers return to position 5*a* and so forth. A downward movement of the chain 2 in the chain channel is prevented. This represents a first operational mode of the chain stopper 3 in which the position of the chain locker pivot axis 6 is stationary by being restrainable in this (original) position by the use of a locking plug 12, as will be described below.

In accordance with the present invention each chain locker pivot axis 6, as a result of forces transmitted by the chain 2 on the respective chain locker 5*a*, 5*b*, further is displaceable from its original position to a stable second position for defining a second operational mode, in which the respective chain locker 5*a* , 5*b*, in its inwardly rotated position, is not able to engage the chain 2 in a manner for preventing a downward shift of the chain 2 in the chain channel 4.

It is noted that in both modes the chain lockers 5*a*, 5*b* may engage or cooperate with stoppers 19 or 20 (see FIGS. 1 and 2) for limiting their outward rotations.

The chain stopper pivot axis 6 is supported by first ends of link arms 7 of which opposite second ends can rotate around a link arm pivot axis 8 (thus the displacement of the chain locker pivot axis 6 is a displacement along an arc of a circle, but in other embodiments other trajectories are conceivable). As appears from FIGS. 1 and 2 each link arm pivot axis 8 comprises two link arms 7. The link arm pivot axes 8 are supported by lugs 9 attached to the housing 3.

Figure 3:
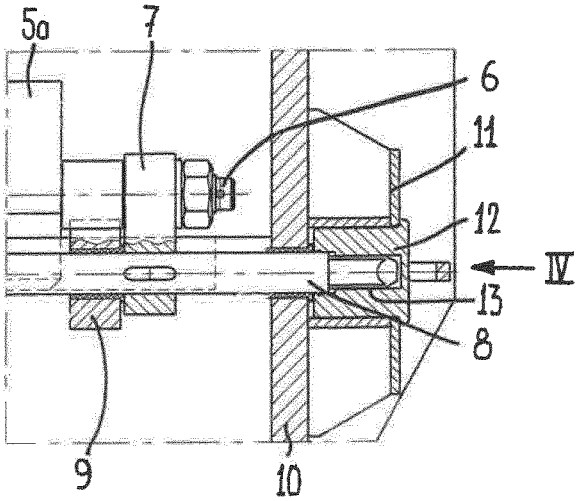
FIG. 3 shows an a larger scale detail III in FIG. 2.
Figure 4:
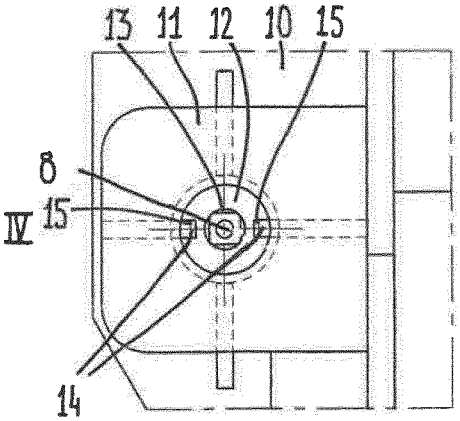
FIG. 4 schematically shows a view according to IV in FIG. 3.

The link arms 7 are non-rotatably connected to a rotatable shaft 8 defining the respective link arm pivot axis (FIGS. 3 and 4). The housing 3 comprises receptacles 11 (in the present embodiment attached to housing walls 10) surrounding the outer ends of the rotatable shaft 8 and configured for receiving a locking plug 12. The locking plug 12 has a central opening 13 for receiving the respective outer end of the rotatable shaft 8 with an inner profile locking mating with a corresponding outer profile of said outer end of the rotatable shaft. In the illustrated embodiment the rotatable shaft 8 has a square cross section and thus the central opening 13 of the locking plug also has a square design.

The locking plug 12 further has an outer profile lockingly mating with an inner profile of the receptacle 11. In the illustrated embodiment the receptacle 11 defines two opposite projections 14 mating with two opposite recesses 15 of the locking plug.

As a result the locking plug 12, once received in the receptacle 11, non-rotatably engages the rotatable shaft 8 and non-rotatably engages the housing 3, thus locking the rotatable shaft 8 against a rotation with respect to the housing 3.

The housing 3 and chain lockers 5*a*, 5*b* are provided with cooperating shoulders 16 and 17, respectively (see FIG. 1), for defining restriction members for preventing a displacement of the chain locker pivot axis 6 from its original position towards its second position before, in the original position of the chain locker pivot axis 6, a rotation of the chain lockers 5*a*, 5*b* out of the inwardly rotated position has occurred. These cooperating shoulders 16, 17 also define the inwardly rotated position of the chain lockers 5*a*, 5*b* in the second position of the chain locker pivot axis 6, as will appear below.

Next, referring to FIGS. 5-8 the operation of the chain stopper 1 for arriving at the second operational mode for paying out or lowering the chain 2 will be described.

Figure 5:
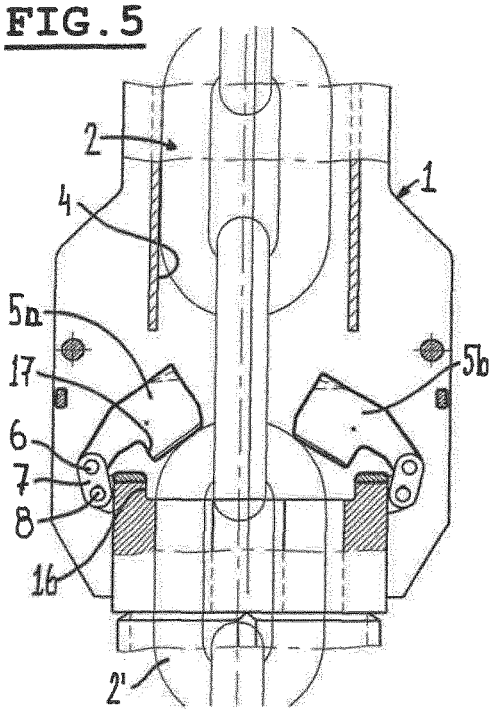
FIGS. 5-8 shows the assembly during successive stages in preparation of and for paying out a chain.

In FIG. 5 the locking plug(s) 12 (not illustrated) has (have) been removed from the receptacle(s) 11 (for example by an ROV) and thus the rotatable shafts or link arm pivot axes 8 are free to rotate (not locked). When the chain is lifted, a chain link 2' engages the chain lockers 5*a*, 5*b* and starts to rotate these outwardly (and upwardly). In the position shown in FIG. 5 the cooperating restriction members (shoulders 16 and 17) have disengaged each other and the forces transmitted by the chain link 2' to the chain lockers 5*a*, 5*b* will result in an outwardly directed force on the chain locker pivot axes 6, thus leading to a displacement thereof outwardly (by a rotation of the link arms 7 around the corresponding link arm pivot axes 8).

Figure 6:
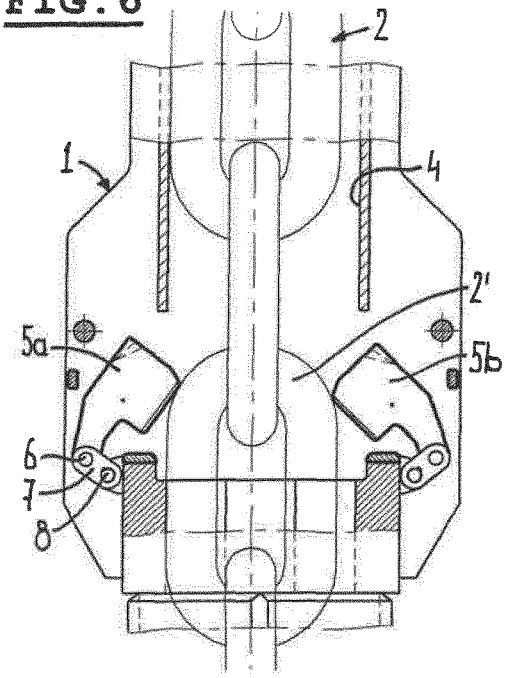

In FIG. 6 the chain 2 is pulled up a little further and it is visible that the chain locker pivot axes 6 have been moved further outward. The chain lockers 5*a*, 5*b* still are "engaged" by the chain link 2' and follow its rounded outer (upper) contour.

Figure 7:
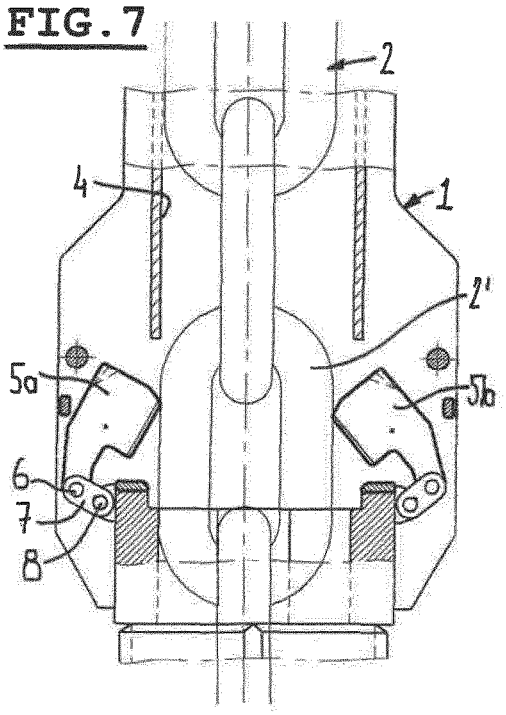

In FIG. 7 the chain lockers 5*a*, 5*b* have reached the widest (vertical) part of the chain link 2' of the chain that is still moving up.

Figure 8:
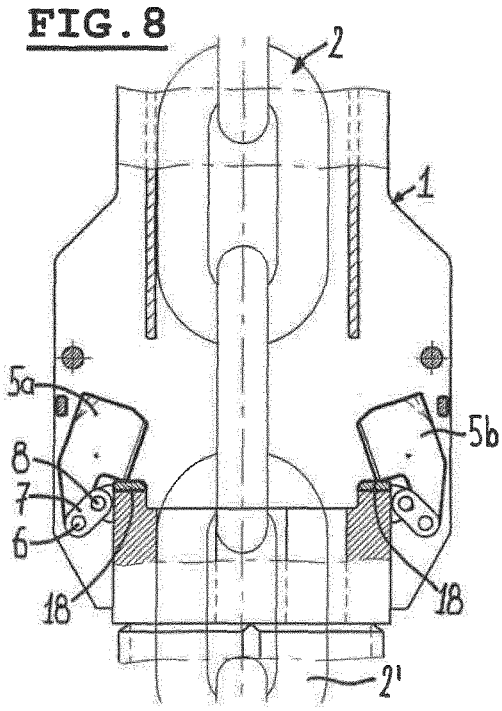

Finally, FIG. 8 shows a situation in which the chain lockers 5*a*, 5*b* have reached a gravity maintained stable position in which the link arms 7 have rotated around the respective link arm pivot axes 8 to a final position and in which the chain lockers 5*a*, 5*b* rest upon supports 18 (which also might correspond with the shoulders 16). In this situation (corresponding with the above mentioned second operational mode) the chain 2 may be lowered or paid-out as far as required, because the chain lockers 5*a*, 5*b* will not engage the chain links 2' in a manner that a downward movement of the chain 2 will be prevented (preferably the chain lockers 5*a*, 5*b* in this second operational mode will not engage the chain links 2', but it is conceivable too that the chain lockers 5*a*, 5*b* engage the chain links 2' but are pushed outwardly thereby (aided by the rounded lower side of the chain links 2') without restricting the downward movement of the chain 2).

It is noted that the moment at which the forces acting on the assembly are such that the chain lockers 5*a*, 5*b* will irreversibly start to move to the stable second position illustrated in FIG. 8 also could occur as early as in the situation illustrated in FIG. 5 (and, as a result, at such a moment the upward movement of the chain 2 could also stop). This will depend on features such as, for example, shape, dimensions, friction and weight distribution of parts and relative position between parts of the chain stopper.

Starting from the situation in FIG. 8 a tool (for example a standardized hydraulic torque tool handled by an ROV) may be used for engaging the rotatable shafts 8 for rotating these back to a situation in accordance with FIG. 5, after which the locking plug(s) 12 may be reinstalled in the receptacles 11 for locking the rotatable shafts 8 (and restraining the chain locker pivot axes 6) and thus again putting the assembly in the first operational mode in which the chain 2 cannot be lowered anymore, but may be lifted, if required.

The invention is not limited to the embodiments described above which may be varied widely within the scope of the invention as defined by the appending claims.

The invention claimed is:

1. An assembly of chain stopper and chain, comprising a housing, a vertically extending chain channel defined in the housing in which a chain is received and guided and two chain lockers positioned at opposite sides of the chain channel, wherein each chain locker is pivotably mounted on a chain locker pivot axis for a rotation between an inwardly rotated position for engaging the chain and preventing a downward shift of the chain in the chain channel, and an outwardly rotated position allowing an upward shift of the chain in the chain channel and wherein each chain locker is biased towards its inwardly rotated position, wherein each chain locker pivot axis as a result of forces transmitted by the chain on the respective chain locker is displaceable from an original position to a stable second position in which the respective chain locker, in its inwardly rotated position, is not able to engage the chain in a manner for preventing a downward shift of the chain in the chain channel and wherein the chain locker pivot axis is restrainable in its original position.

2. The assembly according to claim 1, wherein the displacement of the chain locker pivot axis is a displacement along an arc of a circle.

3. The assembly according to claim 2, wherein the chain stopper pivot axis is supported by first ends of link arms of which opposite second ends rotate around a link arm pivot axis.

4. The assembly according to claim 3, wherein the link arm pivot axis is defined by a lockable rotatable shaft and wherein the link arms are non-rotatably connected to said rotatable shaft.

5. The assembly according to claim 4, wherein a removable locking member is configured to lock the rotatable shaft with respect to the housing.

6. The assembly according to claim 5, wherein the removable locking member non-rotatably engages the rotatable shaft and non-rotatably engages the housing.

7. The assembly according to claim 6, wherein the housing comprises at least one receptacle surrounding an outer end of the rotatable shaft and configured to receive a locking plug, wherein the locking plug has a central opening for receiving said outer end of the rotatable shaft with an inner profile lockingly mating with a corresponding outer profile of said outer end of the rotatable shaft, whereas the locking plug further has an outer profile lockingly mating with an inner profile of the receptacle.

8. The assembly according to claim 1, wherein the housing and chain lockers are provided with cooperating restriction members configured to prevent a displacement of the chain locker pivot axis from the original position towards the second position before, in the original position of the chain locker pivot axis, a rotation of the chain lockers out of the inwardly rotated position has occurred.

9. The assembly according to claim 8, wherein said cooperating restriction members also define the inwardly rotated position of the chain lockers in the second position of the chain locker pivot axis.

10. The assembly according to claim 9, wherein the cooperating restriction members comprise cooperating shoulders on the chain lockers and housing.

11. A chain stopper, comprising a housing, a vertically extending chain channel defined in the housing in which a chain may be received and guided and two chain lockers positioned at opposite sides of the chain channel, wherein each chain locker is pivotably mounted on a chain locker pivot axis for a rotation between an inwardly rotated position for engaging a chain and preventing a downward shift of a chain in the chain channel, and an outwardly rotated position allowing an upward shift of a chain in the chain channel and wherein each chain locker is biased towards its inwardly rotated position, wherein each chain locker pivot axis as a result of forces transmitted by a chain on the respective chain locker is displaceable from an original position to a stable second position in which the respective chain locker, in an inwardly rotated position, is not able to engage a chain in a manner for preventing a downward shift of a chain in the chain channel and wherein the chain locker pivot axis is restrainable in the original position.

12. The chain stopper according to claim 11, wherein the displacement of the chain locker pivot axis is a displacement along an arc of a circle.

13. The chain stopper according to claim 12, wherein the chain stopper pivot axis is supported by first ends of link arms of which opposite second ends can rotate around a link arm pivot axis.

14. The chain stopper according to claim 13, wherein the link arm pivot axis is defined by a lockable rotatable shaft and wherein the link arms are non-rotatably connected to said rotatable shaft.

15. The chain stopper according to claim 14, wherein a removable locking member is configured to lock the rotatable shaft with respect to the housing.

16. The chain stopper according to claim 15, wherein the removable locking member non-rotatably engages the rotatable shaft and non-rotatably engages the housing.

17. The chain stopper according to claim 16, wherein the housing comprises at least one receptacle surrounding an outer end of the rotatable shaft and configured to receive a locking plug, wherein the locking plug has a central opening configured to receive said outer end of the rotatable shaft with an inner profile lockingly mating with a corresponding outer profile of said outer end of the rotatable shaft, whereas the locking plug further has an outer profile lockingly mating with an inner profile of the receptacle.

18. The chain stopper according to claim 11, wherein the housing and chain lockers are provided with cooperating restriction members for preventing a displacement of the chain locker pivot axis from the original position towards the second position before, in the original position of the chain locker pivot axis, a rotation of the chain lockers out of the inwardly rotated position has occurred.

19. The chain stopper according to claim 18, wherein said cooperating restriction members also define the inwardly rotated position of the chain lockers in the second position of the chain locker pivot axis.

20. The chain stopper according to claim 19, wherein the cooperating restriction members comprise cooperating shoulders on the chain lockers and housing.

* * * * *